US005396678A

United States Patent [19]

Bredall et al.

[11] Patent Number: 5,396,678

[45] Date of Patent: Mar. 14, 1995

[54] TOOTHBRUSH WITH RECTANGULAR BRISTLES

[75] Inventors: William A. Bredall, Pacifica, Calif.; Miklos M. Breuer, Newton, Mass.; Ximena A. Gavino; Christopher Loew, both of San Francisco, Calif.; Jeffrey S. Meessmann; Douglas J. McDowell, both of Iowa City, Iowa; Alberto B. Sabato, Atherton, Calif.; Jean L. Spencer, Boston, Mass.; James D. Vidra, Half Moon Bay, Calif.; Stanley Wreford, Boston, Mass.

[73] Assignee: The Gillette Company, Boston, Mass.

[21] Appl. No.: 970,331

[22] Filed: Nov. 2, 1992

[51] Int. Cl.[6] ..... A46B 9/04

[52] U.S. Cl. ..... 15/167.1; 15/191.1; 15/207.2

[58] Field of Search ..... 15/159.1, 160, 167.1, 15/167.2, 186, 187, 199, 207.2, 191.1; 119/85, 86; 132/120, 139, 140, 141, 142, 161

[56] References Cited

U.S. PATENT DOCUMENTS

| | | | |
|---|---|---|---|
| 164,353 | 6/1875 | Wayne | 15/167.1 |
| 531,412 | 12/1894 | Garvey | 119/86 |
| 1,179,426 | 4/1916 | Hamilton | 15/207.2 |
| 2,168,964 | 8/1939 | Strasser | 15/167.1 |
| 2,250,112 | 7/1941 | Larson | 15/160 |
| 2,317,485 | 4/1943 | Rider | 15/167 |
| 2,545,814 | 3/1951 | Kempster | 15/167.1 |
| 2,650,383 | 9/1953 | Bressler | 15/199 |
| 2,777,145 | 1/1957 | Krieger | 15/186 |
| 2,876,477 | 3/1959 | Stewart | 15/167 |
| 3,032,230 | 2/1967 | Puppelman | 15/167 |
| 3,214,777 | 3/1964 | Kutik | 15/187 |
| 3,344,457 | 10/1967 | Grobert | 15/159 |
| 4,167,794 | 9/1979 | Pomeroy | 15/188 |
| 4,471,505 | 9/1984 | Spademan | 15/167 R |
| 4,646,381 | 3/1987 | Weihrauch | 15/167 R |
| 5,009,195 | 4/1991 | Damm | 15/160 |

FOREIGN PATENT DOCUMENTS

| | | | |
|---|---|---|---|
| 4010671 | 8/1990 | Germany | 15/167.1 |
| 0172320 | 12/1934 | Switzerland | 15/159.1 |
| 0637279 | 7/1983 | Switzerland | 15/167.1 |
| 1076967 | 7/1967 | United Kingdom . | |
| 2063064 | 6/1981 | United Kingdom | 15/160 |

*Primary Examiner*—David A. Scherbel
*Assistant Examiner*—Randall E. Chin
*Attorney, Agent, or Firm*—Chester Cekala

[57] ABSTRACT

The present invention relates to a toothbrush which exhibits improved tooth and gum cleaning. The toothbrush includes an elongated handle member connected to a toothbrush head member. A multiplicity of bristles extend from the head member; these bristles being comprised of at least two general directional orientations of bristles having a generally rectangular cross-section.

8 Claims, 4 Drawing Sheets

TOOTHBRUSH WITH RECTANGULAR BRISTLES

BACKGROUND OF THE INVENTION

1. Field of the Invention

The present invention relates to toothbrushes, and more particularly, to toothbrushes which exhibit improved tooth and gum cleaning characteristics. These toothbrushes include toothbrush bristles with a particular geometric cross-sectional area.

2. Description of the Prior Art

Early toothbrushes were fabricated from readily available natural materials. The bristles employed in these brushes ultimately were fabricated of animal bristles, particularly those of the wild boar. This was due to their good flexibility, their liquid retention characteristics and even their appearance. These natural bristles were, of course, round in cross-sectional area.

As synthetic materials, such as various polymeric organic materials, became available, attempts were made to develop synthetic bristle materials which closely resembled the natural bristle materials which had gained widespread acceptance in the marketplace. See, for example British Patent Application 1,076,967 to Societe Rhodiaceta, published Jul. 26, 1967. Typically, these synthetic bristles were produced by extruding the molten synthetic polymer through a round orifice.

As those skilled in the art gain familiarity with the synthetic extrusion technology, they began experimenting with new cross-sectional geometric shapes in an effort to enhance the performance of brushes in general. For example, U.S. Pat. No. 2,317,485, to Rider, issued Apr. 27, 1943 relates to a toothbrush with improved cleaning ability due to the shape and nature of the bristles. The Rider invention stems from the observation that circular cross-sectional bristles do not pack into tuft holes well and that other regular geometric shapes, e.g., triangles, squares, pentagons, hexagons, heptagons, and octagons, allow one to pack more bristles into a given tuft hole. Also, U.S. Pat. No. 2,876,477 to Stewart, issued Mar. 10, 1959 relates to another toothbrush which utilizes polygons of regular cross-sections, e.g. squares, pentagons, hexagons, heptagons, octagons, nonagons, etc. Contrary to Rider, Stewart seeks to maximize interstacial spacing by providing these polygons with a concave contour on each side. Still further, U.S. Pat. No. 3,032,230 to Poppelman, issued Feb. 7, 1967 relates to a toothbrush wherein the bristles, head and handle are molded into a single unit. Poppelman indicates that the preferred bristle cross-section should be of a polygon with at least two acute angles, e.g. triangle, rhombus, and a four-pointed star pattern. Poppelman speculates that those shapes impart a scraping effect on the teeth. And yet further, U.S. Pat. No. 3,344,457 to Grobert, issued Oct. 3, 1967 discloses a paint brush filament with improved paint pickup and release characteristics. Grobert's synthetic filaments are tapered and have a cruciform ("+") cross-sectional area.

With regard to toothbrush bristles with a rectangular cross-sectional area, which are the focus of the present invention, U.S. Pat. No. 3,214,777 to Kutik, issued Mar. 17, 1964, discloses a molded plastic toothbrush wherein the bristles have a rectangular cross-sectional area and the bristles of each adjacent row are slightly staggered. Kutik recognizes that rectangular bristles having flat sides and relatively thin edges permit a free flexing of the bristles transversely while the flexing of the bristles longitudinally is retarded due to the cross-sectional shape of the bristles. Kutik goes on to say that this allows you to have a soft yielding motion in the up and down brushing orientation and firm brushing motion in the in and out orientation (see Col. 1, lines 11–28 and Col. 2, lines 16–23). Kutik does not employ standard bristle material which is typically packed into tuft holes. In fact, Kutik utilizes a molded bristle configuration which employs a plurality of very thin comb-like laminations which are bolted together to form the brush. (see particularly FIG. 6 and 7). In fact, Kutik is silent as to the use of conventional bristle filament materials.

Recently, rectangular bristle filaments of the traditional type, which are affixed to a toothbrush head in tuft bundles, have become available. DuPont Polymers, Wilmington, Del. has recently begun marketing TYNEX® rectangular toothbrush filaments. DuPont indicates that as the bristle anchoring staple is inserted into the tuft hole, most of the bristles orient themselves in a particular directional orientation. DuPont further indicates that brushes fabricated in this manner are stiffer in the direction of the handle and softer from side to side.

These prior art references, taken alone or in combination, fail to teach, imply or suggest the use of more than one directional orientation of rectangular bristles in a toothbrush head. Furthermore, these references fail to appreciate the significant improvement in tooth and gum cleaning which can be realized when at least two directional orientations of rectangular bristles are employed in a toothbrush. It is an object of the present invention to overcome the shortcomings of the prior art and to provide a toothbrush which exhibits improved cleaning performance.

These and other objectives will become evident from the following:

SUMMARY OF THE INVENTION

In accordance with one aspect of the present invention a toothbrush is provided which exhibits improved tooth and gum cleaning. The toothbrush includes an elongated handle member connected to a toothbrush head member. A multiplicity of bristles extend from the head member; these bristles being comprised of at least two general directional orientations of rectangular bristles. In a preferred embodiment of the present invention, the head member is comprised of a "toe" portion distal to the handle and a "heel" portion proximal to the handle, wherein the rectangular bristles extending from the heel portion are generally oriented parallel to the axis of the handle and the rectangular bristles extending from the toe are generally oriented transverse to the axis of the handle. In a still more preferred embodiment of the present invention, the head member is comprised of an "outer" portion generally along the perimeter of the bristle face and an "inner" portion which is generally surrounded by the perimeter portion and wherein the bristles extending from the outer portion are comprised of rectangular bristles generally oriented transverse to the axis of the handle member and wherein the bristles extending from the inner portion are comprised of rectangular bristles generally oriented parallel to the axis of the handle member.

BRIEF DESCRIPTION OF THE DRAWINGS

While the specification concludes with claims which particularly point out and distinctly claim the invention, it is believed the present invention will be better understood from the following description of several particularly preferred embodiments taken in conjunction with the accompanying drawings, in which like reference numerals identify similar elements and wherein:

FIG. 7 is a top profile view of a toothbrush head containing square 61 and rectangular 62 tuft holes.

DETAILED DESCRIPTION OF THE INVENTION

Figure 1:
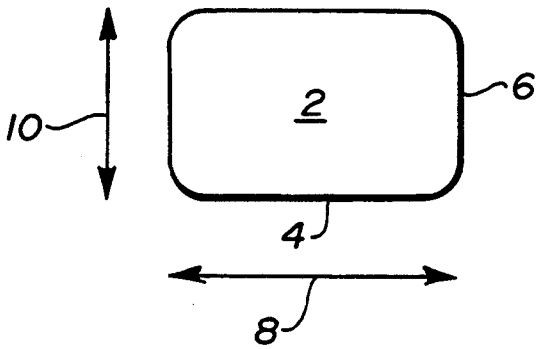
FIG. 1 is a cross-sectional view of a rectangular bristle 2, greatly magnified, suitable for use in toothbrushes of the present invention.

As used herein the term "directional orientation of rectangular bristle" refers to the particular cross-sectional orientation of a rectangular bristle relative to the axis of the handle 28. Rectangles, of course, are parallelograms with right angles which have one side longer than the other. Applicants will refer to the longer side 4 as the length and the narrower side 6 as the width. When a rectangular bristle is oriented in a toothbrush head, the two length sides 4 of the rectangle can be oriented in any angle relative to the axis of the handle 28. When the bristle 2 is oriented such that the length sides 4 are parallel to the axis down the center of the handle 28, the bristle 2 is said to have a directional orientation parallel to the axis of the handle 28. Likewise, when a length side 4 of the bristle is oriented transverse to the axis down the center of the handle 28, the bristle is said to have a directional orientation transverse to the axis of the handle 28. Other angular orientations, e.g., 15°, 30°, 45°, etc., are also encompassed by the present invention. Preferrably, two directional orientations are utilized: one at 0 degrees relative to the handle axis; and one perpendicular to the handle axis, see FIGS. 2 and 3.

As used herein, the term "bristle height" refers to the length measured at right angles to the stock from the top of the free end of the filament to the point at which it enters the tuft hole.

As was mentioned earlier, it is known that a rectangular cross-sectional toothbrush bristle 2 exhibits a different stiffness as it is bent in various length-width orientations As the bristle is bent "lengthwise", as specified by movement arrow 8, in FIG. 1, the bristle is markedly stiffer than a bend in the perpendicular "widthwise" direction, as depicted by movement arrow 10 in FIG. 1. Tufted bristles exhibit stiffness characteristics which are somewhat different than individual bristles because neighboring bristles tend to support and hold each other up. Accordingly, Applicants have developed the following determination for characterizing bristle stiffness utilizing a 4 tuft×4 tuft kernel. When the head is moved along directional axis 52, the overall lengthwise kernel deflection force is measured and when the head is moved along directional axis 54, the overall widthwise kernel deflection force is measured. The kernel as defined above is comprised of round tuft holes 0.067 inches in diameter with a bristle height of 11 mm inches and a tuft spacing of 0.093 inches in the length-wise direction and 0.084 inches in the width-wise direction.

The term "deflection force" as used herein refers to the reaction force caused by the deflection of dry filaments from their normal position by one-third of the weighted mean filament length. Deflection forces are calculated according to the International Standard ISO 8627: 1987(E), incorporated herein by reference, and are reported as the average of 5 passes through the grid. Deflection forces are reported in Newtons (N).

Rectangular bristles according to the present invention are characterized by an overall lengthwise kernel deflection force of from about 2N to about 6N when all bristles in a 4×4 kernel are oriented in a general lengthwise directional orientation and wherein the ratio of lengthwise to widthwise kernel deflection force is in the range of from about 1.3:1 to about 1.6:1.

Applicants have also observed that it is important to maintain proper overall stiffness to ensure good organoleptic properties. This force can be quantified by measuring the overall lengthwise deflection force of the entire brush head. A toothbrush according to the present invention should have an overall lengthwise deflection force of not more than 10N, preferably from about 3N to about 6.5N.

Applicants have discovered that when two or more directional orientations of rectangular bristles are included in a toothbrush bristle pattern, a surprising improvement in cleaning efficiency is observed, both of the teeth and gums. Without being bound to theory, Applicants speculate that while prior art toothbrushes utilizing a single directional orientation of rectangular bristles may benefit from the dual stiffness characteristic of the rectangular bristle, they undoubtedly also suffer from the fact that a single directional orientation of rectangular bristles is highly directional in function. This poses a problem in that good brushing technique requires that the brushing motion must vary to remove plaque and debris from various features in the mouth. For example, a brush which has only a stiff length-wise orientation transverse to the axis of the brush handle would be highly effective at removing debris and plaque from the interdental spaces; however, the resulting lower stiffness as the brush is moved in and out will be relatively ineffective at cleaning the gingival margin.

Figure 3:
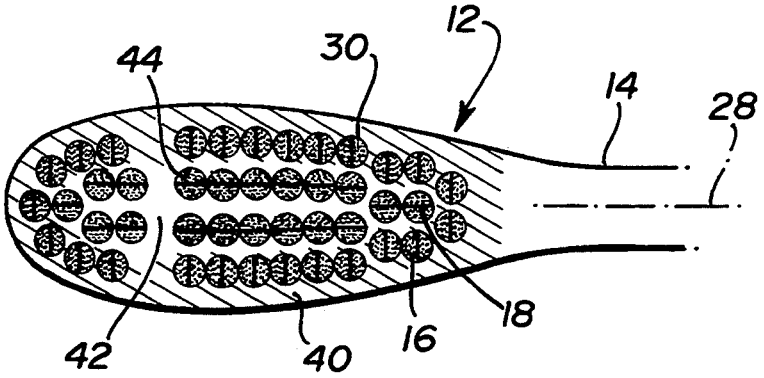
FIG. 3 is a top profile view of a most preferred toothbrush head member 12 according to the present invention.
Figure 4:
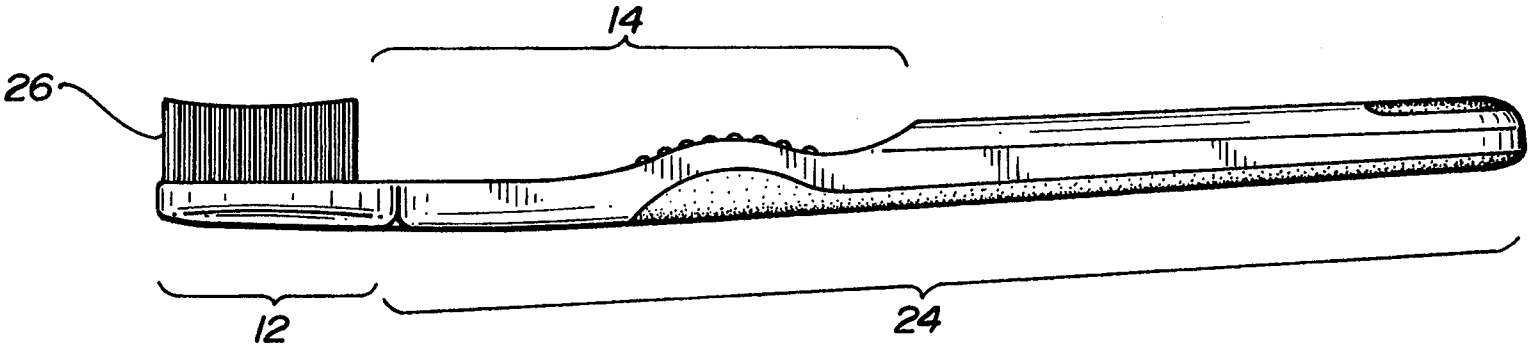
FIG. 4 is a toothbrush embodiment within the scope of the present invention.
Figure 5:
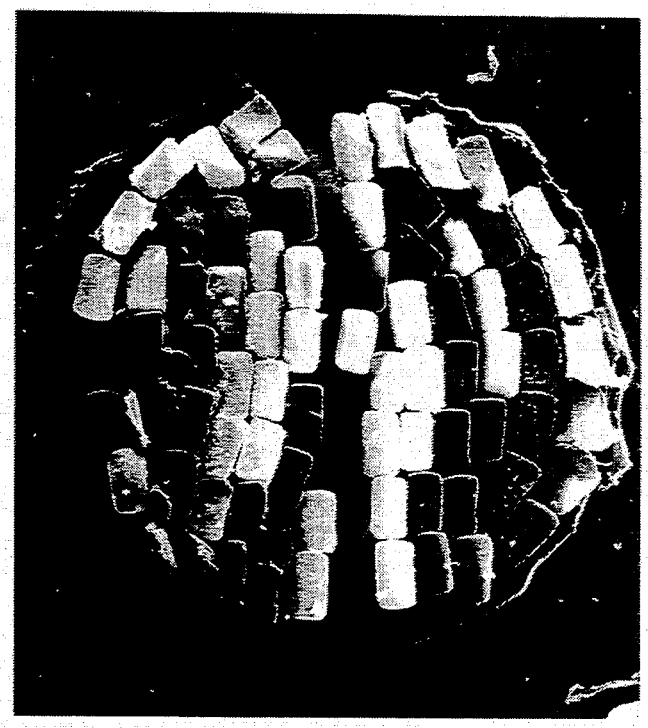
FIG. 5 is a photomicrograph of an individual tuft hole 30 containing rectangular bristles.
Figure 6:
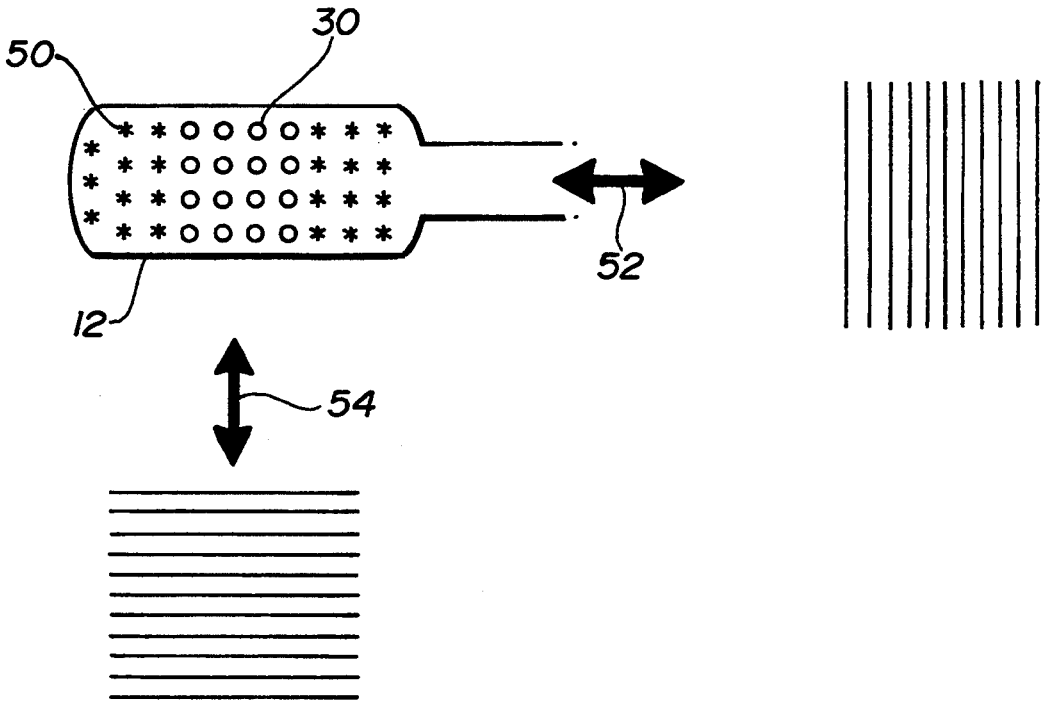
FIG. 6 is a schematic view of a 4 tuft×4 tuft kernal of bristles depicting the deflection force determination parameter which are used to characterize rectangular bristles according to the test described below.

FIG. 4 depicts a toothbrush embodiment within the scope of the present invention. The toothbrush in FIG. 3 is comprised of a handle member 24, a head member 12 and a neck member 14. The brush has a general axis running down the handle of the brush 28. The neck member 14 is an optional feature of the present invention, since many commercial toothbrushes possess no distinct neck feature. The toothbrush further comprises a multiplicity of bristles 26. According to the present method the bristles can be affixed to the head in any way known in the art, e.g. hot tufting, adhesives, staple, etc. The use of a staple to anchor a bristle bundle in a tuft hole is preferred because this technique has proved to be effective at orienting the majority of bristles in the tuft hole parallel to the staple. For example, FIG. 5 shows a toothbrush tuft within the scope of the present invention which has been prepared by the anchoring staple method. This photomicrograph demonstrates the self-orienting effect of the staple which clearly orients the majority of bristles in the tuft hole. Any shape tuft hole can be utilized in the present invention. A most preferred embodiment, applicants have discovered that the highest degree of directional orientation can be achieved with square or rectangular tuft holes.

Figure 2:
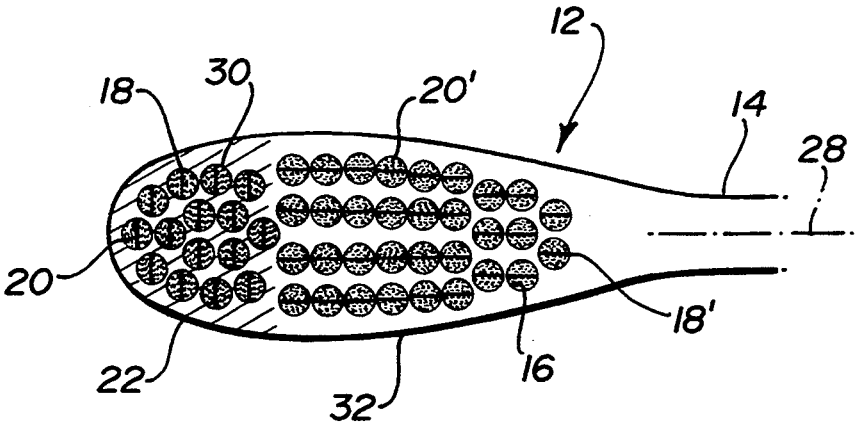
FIG. 2 is a top profile view of a preferred toothbrush head member 12 according to the present invention.

A preferred toothbrush head 12 embodiment is found in FIG. 2. This embodiment includes a head which has a "toe" portion 22 (shaded for emphasis) distal to the handle 24 and a "heel" portion 32 proximal to the handle. The toe portion 22 contains several tuft holes 30 into which the anchoring staple 18 is positioned transverse to the axis along the handle 28. When rectangular bristles 20 are affixed to the head in the toe portion 22 in this manner, the majority of bristles are directionally oriented transverse to the axis along the handle 28. The heel portion also contains several tuft holes 16 into which the anchoring staple 18' is positioned parallel to the axis along the handle 28. When rectangular bristles 20' are thus affixed to the head in the heel portion 32, the majority of the bristles are directionally oriented parallel to the axis along the handle 28.

A most preferred toothbrush head is found in FIG. 3. This embodiment includes a head which has an "outer" portion 40 (shaded for emphasis) generally along the perimeter of the bristle face and an "inner" portion 42 which is generally surrounded by the perimeter portion. The outer portion 40 contains several tuft holes 30 into which the anchoring staple 18 is positioned transverse to the axis along the handle 28. When rectangular bristles 20 are affixed to the head in the outer portion 40 in this manner, the majority of bristles are directionally oriented transverse to the axis along the handle 28. The inner portion 42 also contains several tuft holes 44 into which the anchoring staple 18 is positioned parallel to the axis along the handle 28. When rectangular bristles 20 are thus affixed to the head in the inner portion 42, the majority of the bristles are directionally oriented parallel to the axis of the handle 28.

When utilizing nylon bristle material, the length of the rectangular bristle cross-section is from about 0.004 inches to about 0.015 inches (preferably from about 0.007 inches to about 0.010 inches) and the length: width ratio is from about 1.25 to about 2.0, preferably from about 1.4 to about 1.8. Furthermore, the bristle height of nylon rectangular bristles are preferably from about 8/32 inches to about 17/32 inches. And further still, the preferred bristle height of the rectangular bristles on the toe and heel portions of the head are from about 12/32 to about 17/32 inches, and from about 8/32 to about 14/32 inches, respectively.

The most preferred toothbrush is one wherein all the bristles have a rectangular cross-sectional area.

EXAMPLE The dimensions and characteristics of one exemplary toothbrush embodiment similar to that illustrated in FIG. 3 may include the following:

Tuft hole diameter: 0.067 inches

Toe Bristle: Tynex R bristles manufactured by DuPont Polymers, Wilmington, Del., Length/Width=0.009 inches/0.006 inches.

Heel Bristle: Tynex® bristles manufactured by DuPont Polymers, Wilmington, Del., Length/Width=0.0075 inches/0.005 inches.

Toe Bristle height: ⅜ inches proximal to the heel, increasing to 17/32 inches distal to the heel.

Heel Bristle height: ⅜ inches with a ⅛" "V" groove cut down the longitudinal axis of the heel.

Even though the FIG. 3 brush, described in the Example above, utilizes an inner/outer rectangular bristle orientation, the bristles are cut into different tip heights based on the toe and heel portions of the head.

Although particular embodiments of the present invention have been shown and described, modification may be made to the toothbrush without departing from the teachings of the present invention. For example, brushes which utilize rectangular bristles in conjunction with other geometric cross-sections is also contemplated by the present invention. Likewise, additional bristle materials can also be utilized, such as wear-indicating bristles like the ones described in U.S. Pat. No. 4,802,255 to Breuer, incorporated herein by reference. Also, rectangular bristles with rounded edges are also contemplated by the present invention. Accordingly, the present invention comprises all embodiments within the scope of the appended claims.

What is claimed is:

1. A toothbrush exhibiting improved tooth and gum cleaning comprising:

(a) an elongated handle member having a central axis with a proximal end and a distal end;

(b) a head member connected to the distal end of the handle member, and (c) a multiplicity of bristles affixed to said head member in the form of a plurality of tufts, wherein each of said bristles have a substantially constant cross-section which is a parallelogram with angles which have one side, the length, longer than another side, the width, and wherein the majority of the bristles in a given tuft are directionally oriented such that the length side of said bristle cross section forms an angle relative to said central axis of said handle, and wherein tufts having at least two different directional orientations of bristles are utilized.

2. A toothbrush according to claim 1 wherein said bristles are dry and wherein a deflection force of not more than 10N is applied to the dry bristles along said central axis to cause said bristles to deflect from their normal position by one-third of the weighted mean filament length.

3. A toothbrush according to claim 2 wherein a deflection force of from about 3N to about 6.5N is applied to the dry bristles along said central axis to cause said bristles to deflect from their normal position by one-third of the weighted mean filament length.

4. A toothbrush according to claim 1 wherein tufts having two different directional orientations of bristles are utilized.

5. A toothbrush according to claim 1 wherein said bristles have a cross-sectional length of from about 0.004 inches to 0.015 inches and have a length:width ratio of from about 1.25 to about 2.00.

6. A toothbrush according to claim 5 wherein said bristles have a length of from about 0.007 inches to about 0.010 inches and have a length:width ratio of from about 1.4 to about 2.0.

7. A toothbrush according to claim 1 wherein said bristles are affixed to said head in square cross-sectional tuft holes.

8. A toothbrush according to claim 1 wherein said bristles are affixed to said head in rectangular cross-sectional tuft holes.

* * * * *